US010068753B2

(12) United States Patent
Bloomfield et al.

(10) Patent No.: US 10,068,753 B2
(45) **Date of Patent: *Sep. 4, 2018**

(54) SYSTEMS AND METHODS FOR IDENTIFYING PRECURSOR IONS FROM PRODUCT IONS USING ARBITRARY TRANSMISSION WINDOWING

(71) Applicant: DH Technologies Development Pte. Ltd., Singapore (SG)

(72) Inventors: Nic G. Bloomfield, Newmarket (CA); Frank Londry, Omemee (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 15/026,237

(22) PCT Filed: Oct. 7, 2014

(86) PCT No.: PCT/IB2014/002038

§ 371 (c)(1),
(2) Date: Mar. 30, 2016

(87) PCT Pub. No.: WO2015/056066

PCT Pub. Date: Apr. 23, 2015

(65) Prior Publication Data

US 2016/0268111 A1 Sep. 15, 2016

Related U.S. Application Data

(60) Provisional application No. 61/891,572, filed on Oct. 16, 2013.

(51) Int. Cl.

| | |
|---|---|
| ***H01J 49/00*** | (2006.01) |
| ***H01J 49/06*** | (2006.01) |
| ***H01J 49/40*** | (2006.01) |
| ***H01J 49/42*** | (2006.01) |

(52) U.S. Cl.

CPC ..... *H01J 49/0036* (2013.01); *H01J 49/004* (2013.01); *H01J 49/0027* (2013.01); *H01J 49/061* (2013.01); *H01J 49/40* (2013.01); *H01J 49/427* (2013.01); *H01J 49/4215* (2013.01)

(58) Field of Classification Search

USPC ..... 250/282

See application file for complete search history.

(56) References Cited

U.S. PATENT DOCUMENTS

| | | | | |
|---|---|---|---|---|
| 6,373,052 | B1 * | 4/2002 | Hoyes | H01J 49/0036 250/282 |
| 6,983,213 | B2 * | 1/2006 | Wang | G06K 9/00496 702/85 |
| 7,365,309 | B2 * | 4/2008 | Denny | H01J 49/0036 250/281 |
| 7,952,066 | B2 * | 5/2011 | Pappin | H01J 49/0036 250/282 |
| 9,472,387 | B2 * | 10/2016 | Bloomfield | H01J 49/0027 |
| 2009/0194688 | A1 | 8/2009 | Batman et al. | |
| 2010/0280764 | A1 | 11/2010 | Thomson et al. | |
| 2010/0286927 | A1 | 11/2010 | Horn et al. | |
| 2010/0301205 | A1 * | 12/2010 | Thomson | H01J 49/0027 250/283 |
| 2012/0158318 | A1 | 6/2012 | Wright | |
| 2015/0025813 | A1 * | 1/2015 | Collings | H01J 49/0031 702/24 |

FOREIGN PATENT DOCUMENTS

WO 2013044401 A1 4/2013

OTHER PUBLICATIONS

International Search Report and Written Opinion for PCT/IB2014/002038, dated Jan. 28, 2015.

* cited by examiner

*Primary Examiner* — Phillip A Johnston
(74) *Attorney, Agent, or Firm* — John R. Kasha; Kelly L. Kasha; Kasha Law LLC

(57) ABSTRACT

A transmission window that has a constant rate of precursor ion transmission for each precursor ion is stepped across a mass range, producing a series of overlapping transmission windows across the mass range. The precursor ions produced at each step are fragmented. Resulting product ions are analyzed, producing a product ion spectrum for each step of the transmission window and a plurality of product ion spectra for the mass range. For at least one product ion of the plurality of product ion spectra, a function that describes how an intensity of the at least one product ion from the plurality of product ion spectra varies with precursor ion mass as the transmission window is stepped across the mass range is calculated. A precursor ion of the at least one product ion is identified from the function. An elution profile can also be determined from the function.

17 Claims, 11 Drawing Sheets

100

500

SYSTEMS AND METHODS FOR IDENTIFYING PRECURSOR IONS FROM PRODUCT IONS USING ARBITRARY TRANSMISSION WINDOWING

CROSS REFERENCE TO RELATED APPLICATION

This application claims the benefit of U.S. Provisional Patent Application Ser. No. 61/891,572, filed Oct. 16, 2013, the content of which is incorporated by reference herein in its entirety.

INTRODUCTION

Tandem mass spectrometry or mass spectrometry/mass spectrometry (MS/MS) is a method that can provide both qualitative and quantitative information. In tandem mass spectrometry, a precursor ion is selected or transmitted by a first mass analyzer, fragmented, and the fragments, or product ions, are analyzed by a second mass analyzer or in a second scan of the first analyzer. The product ion spectrum can be used to identify a molecule of interest. The intensity of one or more product ions can be used to quantitate the amount of the compound present in a sample.

Selected reaction monitoring (SRM) is a well-known tandem mass spectrometry technique in which a single precursor ion is transmitted, fragmented, and the product ions are passed to a second analyzer, which analyzes a selected product mass range. A response is generated when the selected precursor ion fragments to produce a product ion in the selected fragment mass range. The response of the product ion can be used for quantitation, for example.

The sensitivity and specificity of a tandem mass spectrometry technique, such as SRM, is affected by the width of the precursor mass window, or precursor mass transmission window, selected by the first mass analyzer. Wide precursor mass windows transmit more ions giving increased sensitivity. However, wide precursor mass windows may also allow precursor ions of different masses to pass. If the precursor ions of other masses produce product ions at the same mass as the selected precursor, ion interference can occur. The result is decreased specificity.

In some mass spectrometers the second mass analyzer can be operated at high resolution and high speed, allowing different product ions to more easily be distinguished. To a large degree, this allows recovery of the specificity lost by using a wide precursor mass window. As a result, these mass spectrometers make it feasible to use a wide precursor mass window to maximize sensitivity while, at the same time, recovering specificity.

One tandem mass spectrometry technique that was developed to take advantage of this property of high resolution and high speed mass spectrometers is sequential windowed acquisition (SWATH). SWATH allows a mass range to be scanned within a time interval using multiple precursor ion scans of adjacent or overlapping precursor mass windows. A first mass analyzer selects each precursor mass window for fragmentation. A high resolution second mass analyzer is then used to detect the product ions produced from the fragmentation of each precursor mass window. SWATH allows the sensitivity of precursor ion scans to be increased without the traditional loss in specificity.

Unfortunately, however, the increased sensitivity that is gained through the use of sequential precursor mass windows in the SWATH method is not without cost. Each of these precursor mass windows can contain many other precursor ions, which confounds the identification of the correct precursor ion for a set of product ions. Essentially, the exact precursor ion for any given product ion can only be localized to a precursor mass window. As a result, additional systems and methods are needed to correlate precursor and product ions from SWATH data.

SUMMARY

A system is disclosed for identifying a precursor ion of a product ion in a tandem mass spectrometry experiment. The system includes a mass filter, a fragmentation device, a mass analyzer, and a processor.

The mass filter steps a transmission window that has a constant rate of precursor ion transmission for each precursor ion across a mass range. Stepping a transmission window produces a series of overlapping transmission windows across the mass range. The fragmentation device fragments the precursor ions produced at each step. The mass analyzer analyzes resulting product ions, producing a product ion spectrum for each step of the transmission window and a plurality of product ion spectra for the mass range.

The processor receives the plurality of product ion spectra produced by the series of overlapping transmission windows. For at least one product ion of the plurality of product ion spectra, the processor calculates a function that describes how an intensity of the at least one product ion from the plurality of product ion spectra varies with precursor ion mass as the transmission window is stepped across the mass range. The processor identifies a precursor ion of the at least one product ion from the function.

A method is disclosed for identifying a precursor ion of a product ion in a tandem mass spectrometry experiment.

A transmission window that has a constant rate of precursor ion transmission for each precursor ion is stepped across a mass range using a mass filter, producing a series of overlapping transmission windows across the mass range. The precursor ions produced at each step is fragmented using a fragmentation device. Resulting product ions are analyzed using a mass analyzer, producing a product ion spectrum for each step of the transmission window and a plurality of product ion spectra for the mass range. The plurality of product ion spectra produced by the series of overlapping transmission windows are received using a processor. For at least one product ion of the plurality of product ion spectra, a function that describes how an intensity of the at least one product ion from the plurality of product ion spectra varies with precursor ion mass as the transmission window is stepped across the mass range is calculated using the processor. A precursor ion of the at least one product ion from the function is identified using the processor.

A computer program product is disclosed that includes a non-transitory and tangible computer-readable storage medium whose contents include a program with instructions being executed on a processor so as to perform a method for identifying a precursor ion of a product ion in a tandem mass spectrometry experiment. In various embodiments, the method includes providing a system, wherein the system comprises one or more distinct software modules, and wherein the distinct software modules comprise a measurement module and a analysis module.

The measurement module receives a plurality of product ion spectra produced by a series of overlapping transmission windows. The plurality of product ion spectra are produced by stepping a transmission window that has a constant rate of precursor ion transmission for each precursor ion across a mass range using a mass filter, producing the series of overlapping transmission windows across the mass range. The plurality of product ion spectra are produced by further fragmenting the precursor ions produced at each step using a fragmentation device. The plurality of product ion spectra are produced by further analyzing resulting product ions using a mass analyzer, producing a product ion spectrum for each step of the transmission window and the plurality of product ion spectra for the mass range.

For at least one product ion of the plurality of product ion spectra, the analysis module calculates a function that describes how an intensity of the at least one product ion from the plurality of product ion spectra varies with precursor ion mass as the transmission window is stepped across the mass range. The analysis module identifies a precursor ion of the at least one product ion from the function.

A system is disclosed for reconstructing a separation profile of a precursor ion in a tandem mass spectrometry experiment from multiple scans across a mass range. The system includes a separation device, a mass filter, a fragmentation device, a mass analyzer, and a processor.

The separation device separates ions from a sample. The mass filter receives the ions from the separation device and filters the ions by, in each of two or more scans across a mass range, stepping a transmission window that has a constant rate of precursor ion transmission for each precursor ion across the mass range. Stepping a transmission window produces a series of overlapping transmission windows across the mass range for each scan of the two or more scans.

The fragmentation device fragments the precursor ions produced at each step. The mass analyzer analyzes resulting product ions, producing a product ion spectrum for each step of the transmission window and a plurality of product ion spectra for the mass range for the each scan.

The processor receives the plurality of product ion spectra produced by the series of overlapping transmission windows for the each scan, producing a plurality of multi-scan product ion spectra. The processor selects at least one product ion from the plurality of multi-scan product ion spectra that is present at least two or more times in product ion spectra from each of two or more scans. The processor fits a known separation profile of a precursor ion to intensities from the at least one product ion in the plurality of multi-scan product ion spectra to reconstruct a separation profile of a precursor ion of the at least one product ion.

A method is disclosed for reconstructing a separation profile of a precursor ion in a tandem mass spectrometry experiment from multiple scans across a mass range. Ions are separated from a sample over time using a separation device.

The ions are filtered using a mass filter by, in each of two or more scans across a mass range, stepping a transmission window that has a constant rate of precursor ion transmission for each precursor ion across the mass range. Stepping a transmission window produces a series of overlapping transmission windows across the mass range for each scan of the two or more scans.

The precursor ions produced at each step is fragmented using a fragmentation device. Resulting product ions are analyzed using a mass analyzer, producing a product ion spectrum for each step of the transmission window and a plurality of product ion spectra for the mass range for the each scan. The plurality of product ion spectra produced by the series of overlapping transmission windows are received for the each scan, producing a plurality of multi-scan product ion spectra using a processor.

At least one product ion is selected from the plurality of multi-scan product ion spectra that is present at least two or more times in product ion spectra from each of two or more scans using the processor. A known separation profile of a precursor ion is fit to intensities from the at least one product ion in the plurality of multi-scan product ion spectra to reconstruct a separation profile of a precursor ion of the at least one product ion using the processor.

A computer program product is disclosed that includes a non-transitory and tangible computer-readable storage medium whose contents include a program with instructions being executed on a processor so as to perform a method for reconstructing a separation profile of a precursor ion in a tandem mass spectrometry experiment from multiple scans across a mass range. In various embodiments, the method includes providing a system, wherein the system comprises one or more distinct software modules, and wherein the distinct software modules comprise a measurement module and a analysis module.

The measurement module receives a plurality of product ion spectra for each scan of two or more scans across a mass range produced by a series of overlapping transmission windows using the measurement module, producing a plurality of multi-scan product ion spectra. The plurality of product ion spectra for each scan are produced by separating ions from a sample over time using a separation device. The plurality of product ion spectra for each scan are produced by further filtering the ions using a mass filter by, in each of the two or more scans across the mass range, stepping a transmission window that has a constant rate of precursor ion transmission for each precursor ion across the mass range, producing the series of overlapping transmission windows across the mass range for each scan of the two or more scans. The plurality of product ion spectra for each scan are produced by further fragmenting the precursor ions produced at each step using a fragmentation device. The plurality of product ion spectra for each scan are produced by further analyzing resulting product ions using a mass analyzer, producing a product ion spectrum for each step of the transmission window and the plurality of product ion spectra for the mass range for the each scan.

The analysis module selects at least one product ion from the plurality of multi-scan product ion spectra that is present at least two or more times in product ion spectra from each of two or more scans. The analysis module fits a known separation profile of a precursor ion to intensities from the at least one product ion in the plurality of multi-scan product ion spectra to reconstruct a separation profile of a precursor ion of the at least one product ion.

These and other features of the applicant's teachings are set forth herein.

BRIEF DESCRIPTION OF THE DRAWINGS

The skilled artisan will understand that the drawings, described below, are for illustration purposes only. The drawings are not intended to limit the scope of the present teachings in any way.

Figure 1:
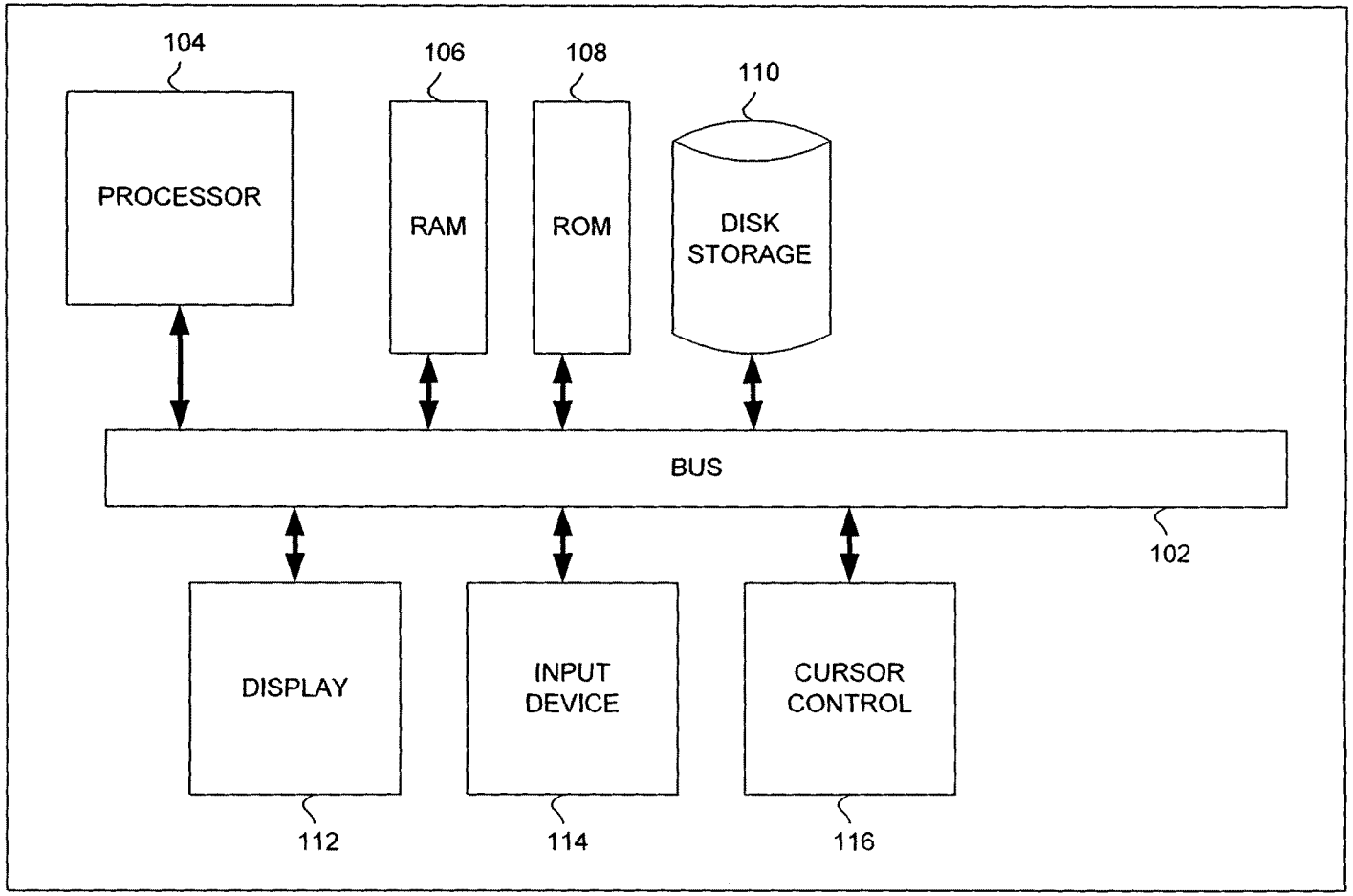
FIG. 1 is a block diagram that illustrates a computer system, upon which embodiments of the present teachings may be implemented.

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF VARIOUS EMBODIMENTS

Computer-Implemented System

FIG. 1 is a block diagram that illustrates a computer system 100, upon which embodiments of the present teachings may be implemented. Computer system 100 includes a bus 102 or other communication mechanism for communicating information, and a processor 104 coupled with bus 102 for processing information. Computer system 100 also includes a memory 106, which can be a random access memory (RAM) or other dynamic storage device, coupled to bus 102 for storing instructions to be executed by processor 104. Memory 106 also may be used for storing temporary variables or other intermediate information during execution of instructions to be executed by processor 104. Computer system 100 further includes a read only memory (ROM) 108 or other static storage device coupled to bus 102 for storing static information and instructions for processor 104. A storage device 110, such as a magnetic disk or optical disk, is provided and coupled to bus 102 for storing information and instructions.

Computer system 100 may be coupled via bus 102 to a display 112, such as a cathode ray tube (CRT) or liquid crystal display (LCD), for displaying information to a computer user. An input device 114, including alphanumeric and other keys, is coupled to bus 102 for communicating information and command selections to processor 104. Another type of user input device is cursor control 116, such as a mouse, a trackball or cursor direction keys for communicating direction information and command selections to processor 104 and for controlling cursor movement on display 112. This input device typically has two degrees of freedom in two axes, a first axis (i.e., x) and a second axis (i.e., y), that allows the device to specify positions in a plane.

A computer system 100 can perform the present teachings. Consistent with certain implementations of the present teachings, results are provided by computer system 100 in response to processor 104 executing one or more sequences of one or more instructions contained in memory 106. Such instructions may be read into memory 106 from another computer-readable medium, such as storage device 110. Execution of the sequences of instructions contained in memory 106 causes processor 104 to perform the process described herein. Alternatively hard-wired circuitry may be used in place of or in combination with software instructions to implement the present teachings. Thus implementations of the present teachings are not limited to any specific combination of hardware circuitry and software.

The term "computer-readable medium" as used herein refers to any media that participates in providing instructions to processor 104 for execution. Such a medium may take many forms, including but not limited to, non-volatile media, volatile media, and transmission media. Non-volatile media includes, for example, optical or magnetic disks, such as storage device 110. Volatile media includes dynamic memory, such as memory 106. Transmission media includes coaxial cables, copper wire, and fiber optics, including the wires that comprise bus 102.

Common forms of computer-readable media include, for example, a floppy disk, a flexible disk, hard disk, magnetic tape, or any other magnetic medium, a CD-ROM, digital video disc (DVD), a Blu-ray Disc, any other optical medium, a thumb drive, a memory card, a RAM, PROM, and EPROM, a FLASH-EPROM, any other memory chip or cartridge, or any other tangible medium from which a computer can read.

Various forms of computer readable media may be involved in carrying one or more sequences of one or more instructions to processor 104 for execution. For example, the instructions may initially be carried on the magnetic disk of a remote computer. The remote computer can load the instructions into its dynamic memory and send the instructions over a telephone line using a modem. A modem local to computer system 100 can receive the data on the telephone line and use an infra-red transmitter to convert the data to an infra-red signal. An infra-red detector coupled to bus 102 can receive the data carried in the infra-red signal and place the data on bus 102. Bus 102 carries the data to memory 106, from which processor 104 retrieves and executes the instructions. The instructions received by memory 106 may optionally be stored on storage device 110 either before or after execution by processor 104.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

The following descriptions of various implementations of the present teachings have been presented for purposes of illustration and description. It is not exhaustive and does not limit the present teachings to the precise form disclosed. Modifications and variations are possible in light of the above teachings or may be acquired from practicing of the present teachings. Additionally, the described implementation includes software but the present teachings may be implemented as a combination of hardware and software or in hardware alone. The present teachings may be implemented with both object-oriented and non-object-oriented programming systems.

Systems and Methods for Identifying Precursor Ions

As described above, sequential windowed acquisition (SWATH) is a tandem mass spectrometry technique that allows a mass range to be scanned within a time interval using multiple precursor ion scans of adjacent or overlapping precursor mass windows. A first mass analyzer selects each precursor mass window for fragmentation. A high resolution second mass analyzer is then used to detect the product ions produced from the fragmentation of each precursor mass window. SWATH allows the sensitivity of precursor ion scans to be increased without the traditional loss in specificity.

Unfortunately, however, the increased sensitivity that is gained through the use of sequential precursor mass windows in the SWATH method is not without cost. Each of these precursor mass windows can contain many other precursor ions, which confounds the identification of the correct precursor ion for a set of product ions. Essentially, the exact precursor ion for any given product ion can only be localized to a precursor mass window. As a result, additional systems and methods are needed to correlate precursor and product ions from SWATH data.

Figure 2:
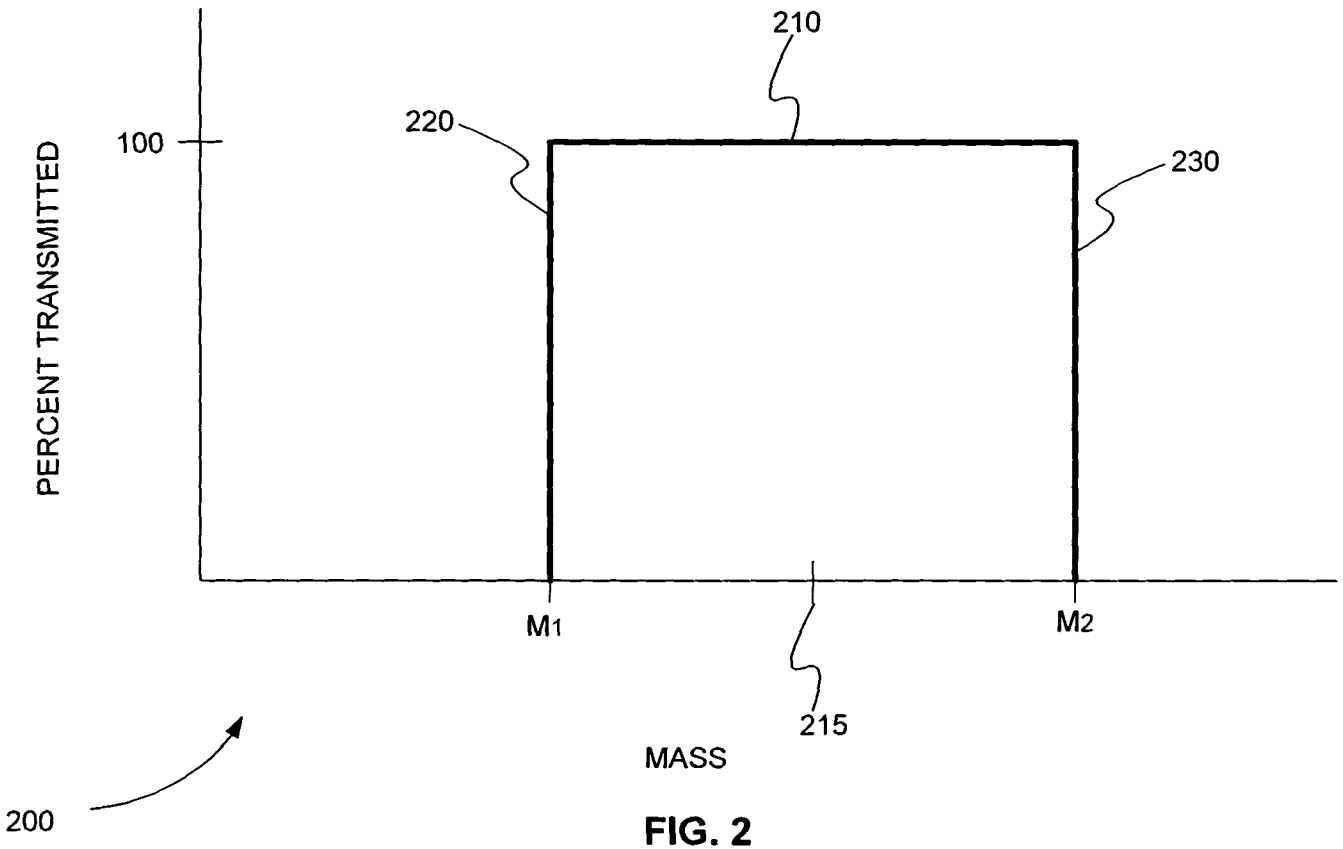
FIG. 2 is an exemplary plot of a single transmission window that is typically used to transmit a sequential windowed acquisition (SWATH) precursor mass window, in accordance with various embodiments.

FIG. 2 is an exemplary plot 200 of a single transmission window that is typically used to transmit a SWATH precursor mass window, in accordance with various embodiments. Transmission window 210 transmits precursor ions with masses between $M_1$ and $M_2$, has set mass, or center mass, 215, and has sharp vertical edges 220 and 230. The SWATH precursor window size is $M_2-M_1$. The rate at which transmission window 210 transmits precursor ion is constant with respect to precursor mass.

In various embodiments, overlapping precursor transmission windows are used to correlate precursor and product ions from SWATH data. For example, a single transmission window such as transmission window 210 of FIG. 2 is shifted in small steps across a precursor mass range so that there is a large overlap between successive transmission windows. As the amount of overlap between transmission windows is increased, the accuracy in correlating the product ions to precursor ions is also increased.

Essentially, when the intensities of product ions produced from precursor ions filtered by the overlapping transmission windows are plotted as a function of the transmission window moving across the precursor mass range, each product ion has an intensity for the same precursor mass range that its precursor ion has been transmitted. In other words, for a rectangular transmission window (such as transmission window 210 of FIG. 2) that transmits precursor ions at a constant rate with respect to precursor mass, the edges (such as edges 220 and 230 of FIG. 2) define a unique boundary of both precursor ion transmission and product ion intensity as the transmission is stepped across the precursor mass range.

Figure 3:
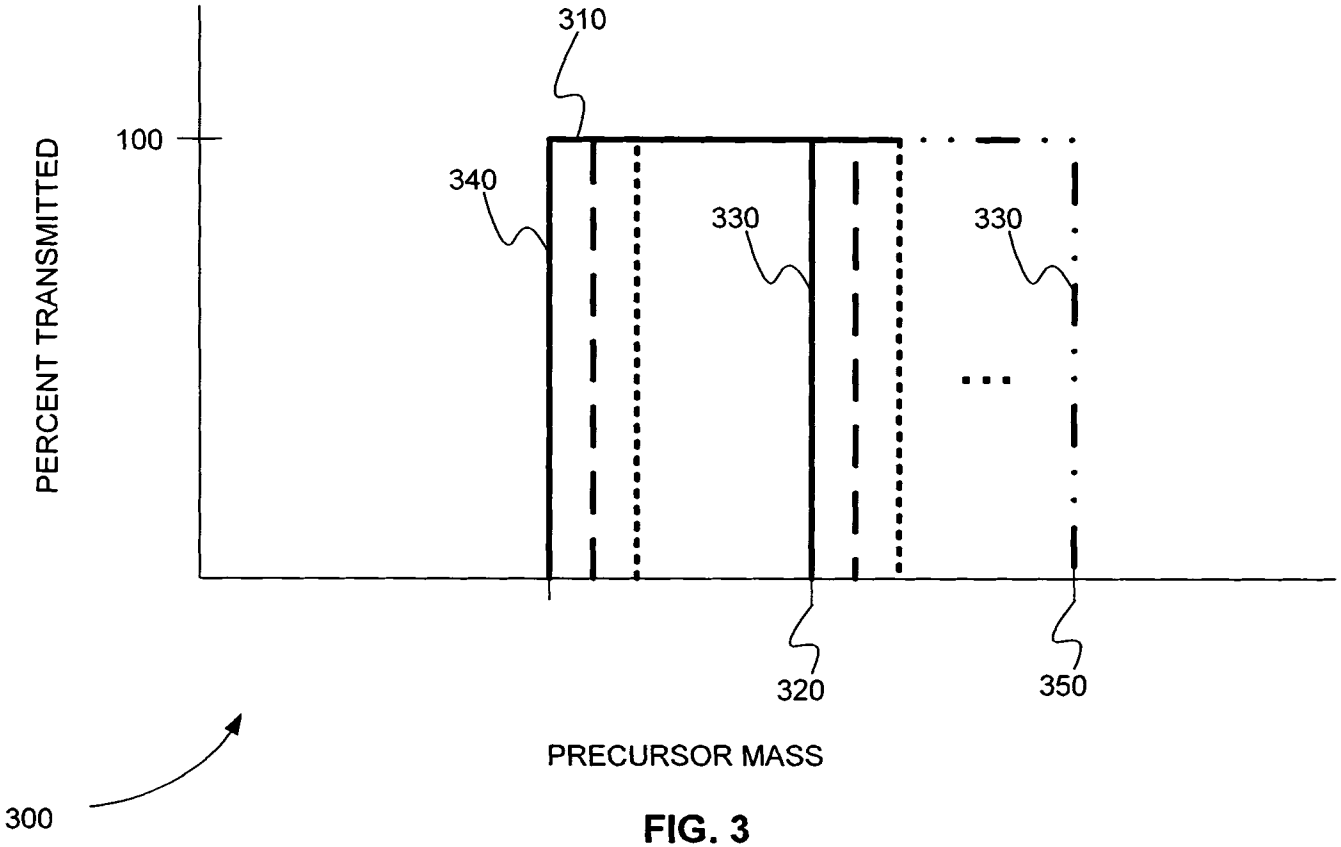
FIG. 3 is an exemplary plot of a transmission window that is shifted across precursor mass window in order to produce overlapping precursor transmission windows, in accordance with various embodiments.

FIG. 3 is an exemplary plot 300 of a transmission window 310 that is shifted across a precursor mass range in order to produce overlapping precursor transmission windows, in accordance with various embodiments. Transmission window 310, for example, starts to transmit precursor ion with mass 320 when leading edge 330 reaches precursor ion with mass 320. As transmission window 310 is shifted across the mass range, the precursor ion with mass 320 is transmitted until trailing edge 340 reaches mass 320.

When the intensities of the product ions from the product ion spectra produced by the overlapping windows are plotted, for example, as a function of the mass of leading edge 330, any product ion produced by the precursor ion with mass 320 would have an intensity between mass 320 and mass 350 of leading edge 330. One skilled in the art can appreciate that the intensities of the product ions produced by the overlapping windows can be plotted as function of the precursor mass based on any parameter of transmission window 310 including, but not limited to, trailing edge 340, set mass, or leading edge 330.

Unfortunately, however, most mass filters are unable to produce transmission windows with sharply defined edges, such as transmission window 310 shown in FIG. 3. As a result, rectangular transmission windows that transmit precursor ions at a constant rate with respect to precursor mass may not directly provide enough accuracy to correlate product ions to their corresponding precursor ions.

In various embodiments, the accuracy of the correlation is improved by combining product ion spectra from successive groups of the overlapping rectangular precursor ion transmission windows. Product ion spectra from successive groups are combined by successively summing the intensities of the product ions in the product ion spectra. This summing produces a function that can have a shape that is non-constant with precursor mass. The shape can be a triangle, for example. The shape describes product ion intensity as a function of precursor mass.

A shape that is non-constant with precursor mass is created to more accurately determine the precursor mass. For example, if a triangle is used, the apex or center of gravity can be used to point to the precursor mass. In other words, if the intensities of the product ions are successively selected and summed to produce a triangular function of intensity with respect to precursor mass, for example, the apex or center of gravity of the function for each product ion points to the precursor ion mass. The apex or center of gravity of the function is less dependent on the accuracy of the measurements at the edges of the actual transmission window. Of course, product ions that are the result of more than one precursor ion may still be difficult to discern.

Figure 4:
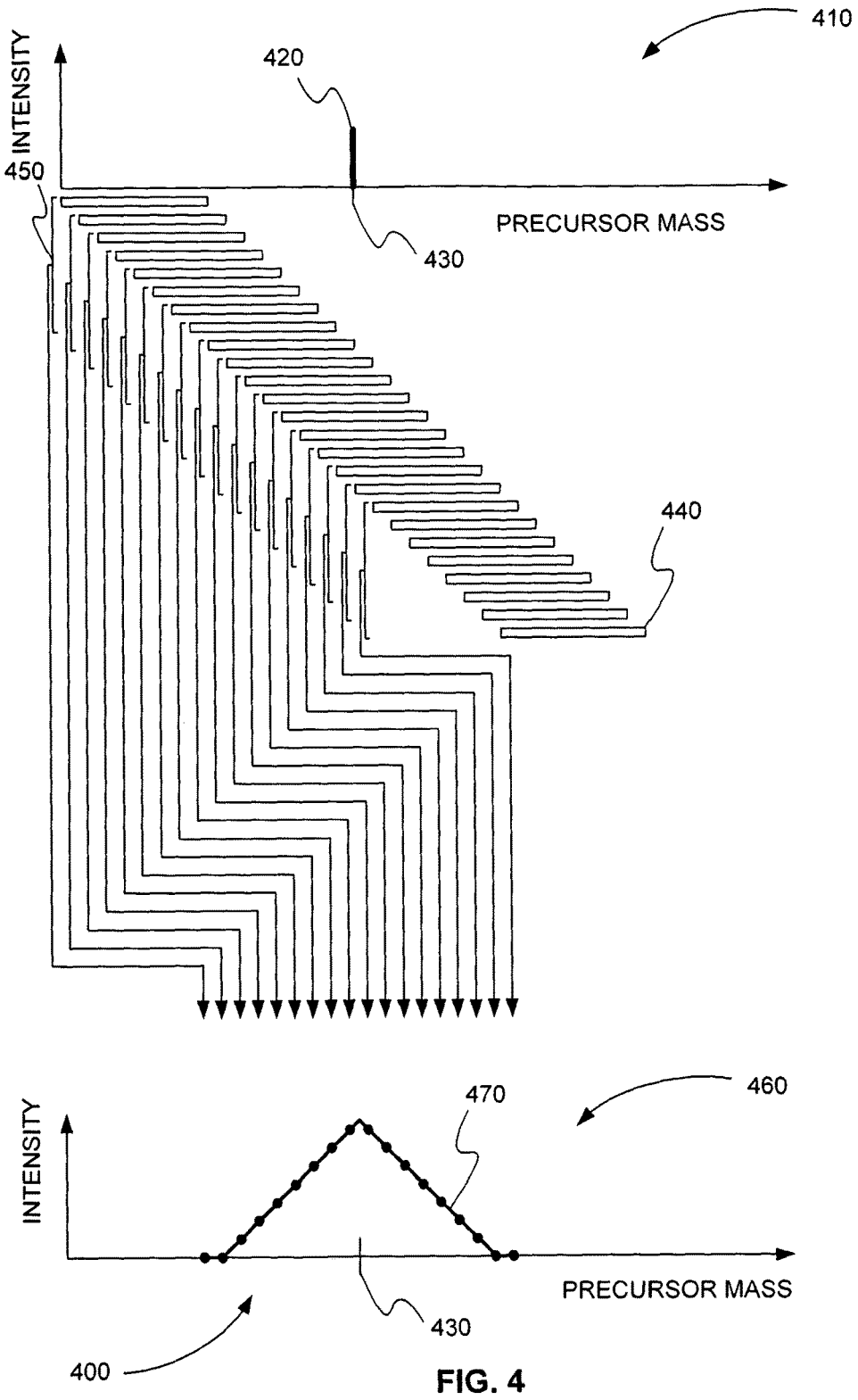
FIG. 4 is diagram showing how product ion spectra from successive groups of the overlapping rectangular precursor ion transmission windows are summed to produce a triangular function that describes product ion intensity as a function of precursor mass, in accordance with various embodiments.

FIG. 4 is diagram 400 showing how product ion spectra from successive groups of the overlapping rectangular precursor ion transmission windows are summed to produce a triangular function that describes product ion intensity as a function of precursor mass, in accordance with various embodiments. Plot 410 shows that there is a precursor ion 420 at mass 430. Overlapping rectangular precursor ion transmission windows 440 are stepped across a mass range producing a plurality of product ion spectrum. Essentially, a product ion spectrum (not shown) is produced for each window 440.

Successive groups 450 of windows 440 are selected. The product ion intensities from spectra (not shown) from the successive groups 450 of windows 440 are summed. This summing produces plot 460. Plot 460 shows that a product ion of precursor ion 420 acquires a triangular shaped function 470 of product ion intensity with respect to precursor mass. Plot 460 also shows that the apex or center of gravity of function 470 points to mass 430 of precursor ion 420.

The methods and systems described above involve a single scan across a mass range using overlapping precursor ion transmission windows. In various embodiments, additional information is obtained by performing two or more scans across a mass range using overlapping precursor ion transmission windows.

In various embodiments, an elution profile can be constructed by performing two or more scans across a mass range using overlapping precursor ion transmission windows. Usually for quantitation, at least eight measurements are needed across a liquid chromatography (LC) peak, for example. Since a single scan takes about one second, it is difficult to get quantitative information on a fast LC elution. A fast LC elution occurs, for example, in the case of small molecules. In contrast, LC elutions in the proteomics case take on the order of tens of seconds. In a fast LC elution, the peak is rising and falling rapidly but it is still possible to detect this behavior within a scan of an overlapped transmission window. If, for example, a window width is 200 DA and a 900 Da mass range is scanned at 1.5 ms per step with overlapping windows, the scan takes 1.35 seconds, but each ion within the range is present in 200 scans and its behavior is observed for 300 ms out of each 1350 ms. As a result, the elution profile can be reconstructed by fitting an elution profile to the fragment ions observed from the overlapping windows.

Figure 5:
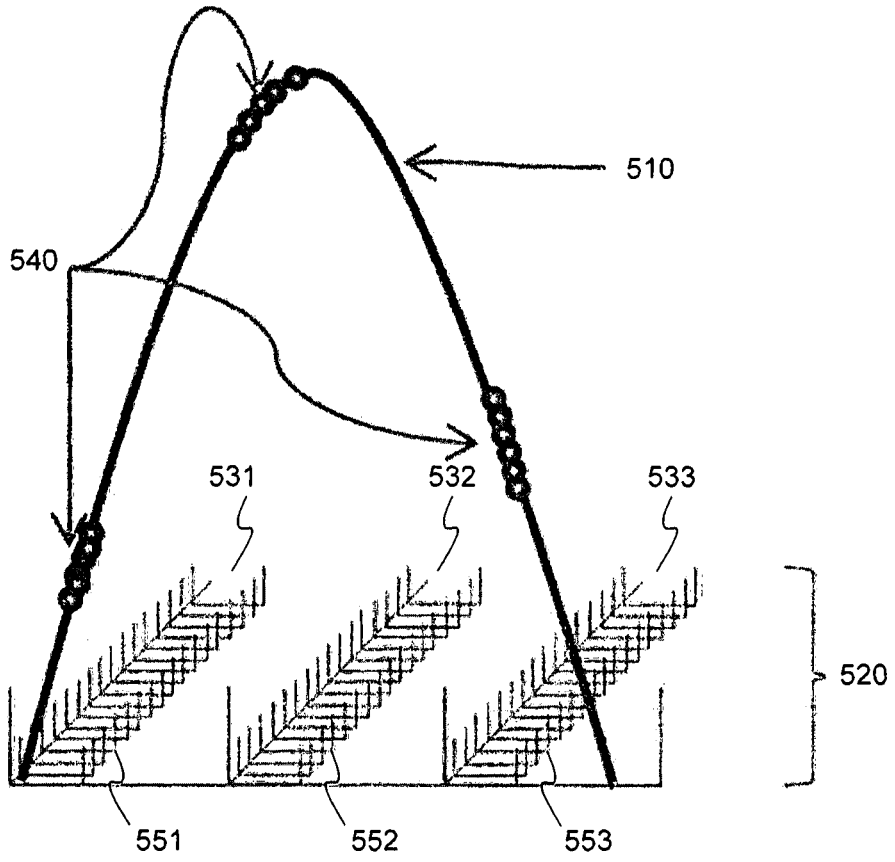
FIG. 5 is diagram showing how it is possible to reconstruct an elution profile using overlapping precursor ion transmission windows, in accordance with various embodiments.

FIG. 5 is diagram 500 showing how it is possible to reconstruct an elution profile using overlapping precursor ion transmission windows, in accordance with various embodiments. Elution profile 510 is reconstructed using overlapping transmission windows 520. Diagram 500 shows three separate scans 531, 532, and 533 of overlapping transmission windows 520 across a mass range. In each of the three scans 531, 532, and 533, fragment ions 540 are found to have intensities corresponding to the elution profile of their precursor ion. One skilled in the art can appreciate that fragments ions 540 can include product ions of the precursor ion and unfragmented ions of the precursor itself. In order to determine elution profile 510 of the precursor ion, fragment ions 540 are fit to known elution profiles.

In various embodiments, overlapping precursor transmission windows can also be used to provide a stronger signal for identifying the precursor ion. As described above, LC elution in the proteomics case take on the order of tens of seconds. For example if a molecule is present for 30 seconds as it elutes from the a column and each scan of the mass range using overlapping transmission takes one second, the molecule is present at varying intensities in 30 scans and in each scan the relationship to the precursor mass function is dependent on intensity only to the extent the higher observed count yields more accurate precursor determination. While the scan at the apex of the LC peak gives the best data for the given molecule, the data can be further strengthened by summing the product ion spectra for all the scans across the LC peak before determining the precursor mass functions. For example the product ions from precursor ions in the range 100 Da to 150 Da from a first scan are summed with those from SWATH 100 Da to 150 DA from the next 30 scan cycles. This is repeated for 101 Da to 151 Da, etc.

As described above and as shown in FIG. 4, the accuracy of the correlation between a product ion and its precursor ion is improved by combining product ion spectra from successive groups of the overlapping rectangular precursor ion transmission windows. In various embodiments, this correlation is further enhanced by summing two or more scans across the mass range before combining product ion spectra from successive groups of the overlapping precursor ion transmission windows.

Returning to FIG. 5, diagram 500 shows three separate scans 531, 532, and 533 of overlapping transmission windows 520 across a mass range. Product ion spectra from the same step of the overlapping windows in the different scans are summed before any grouping takes place. For example, product ion spectra from transmission windows 551, 552, and 553, which are from the same step in the mass range, are summed. The summed spectrum is then grouped with neighboring summed spectra to help identify the precursor ion.

One skilled in the art can appreciate that although reconstructing an elution profile from multiple scans across a mass range is described first and identifying a precursor ion from a product ion selected from multiple scans across a mass range is described second, these actions can be performed in the reverse order. For example, a precursor ion can be identified from multiple scans across a mass range first, and then the elution profile of that precursor ion can be reconstructed from the same multiple scans across a mass range.

Experimental Results

Two experiments were performed where rectangular precursor transmission windows were summed to produce the effect of triangular transmission windows. In the first experiment, a low collision energy of 10 eV was used. In this experiment, a calibration peptide of 829.5393 Da and its isotopes were compared.

Figure 6:
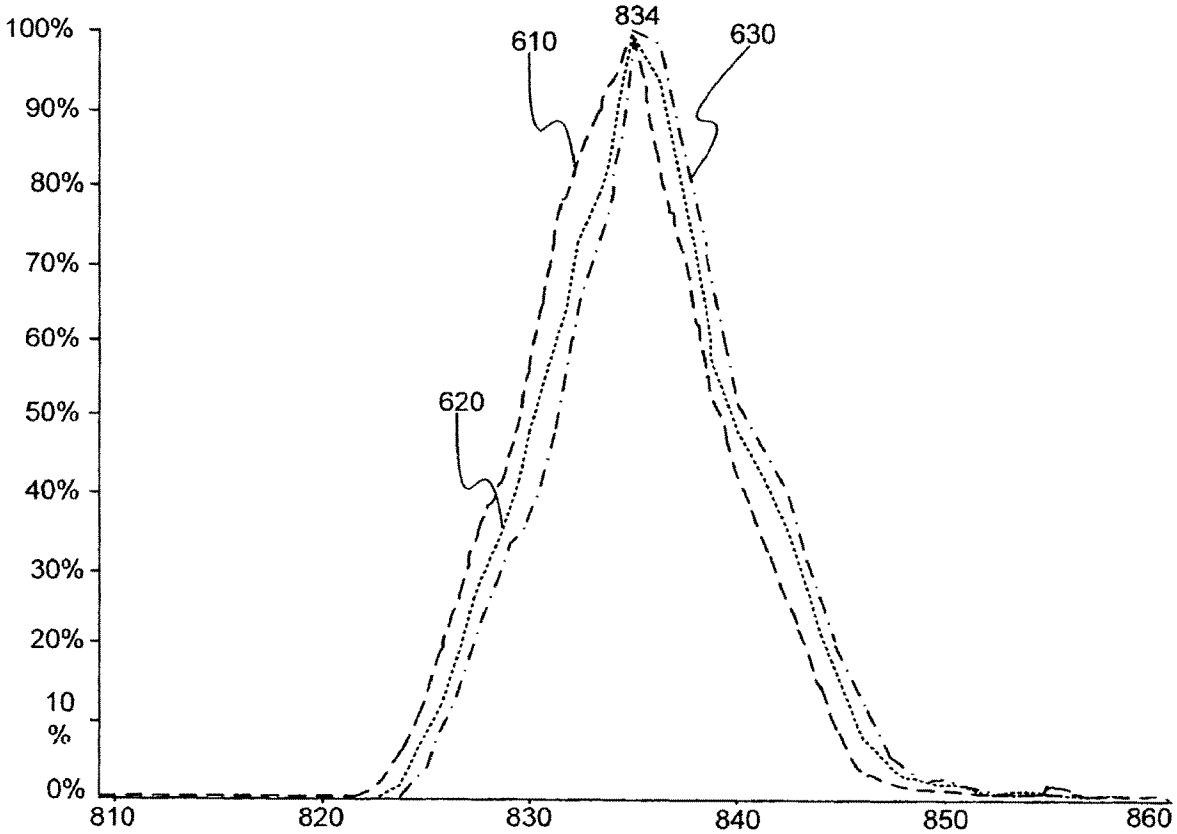
FIG. 6 is an exemplary plot of the product ion intensities as a function of precursor mass of a calibration peptide of 829.5393 Da and its two isotopes produced by a low energy collision experiment, where rectangular precursor transmission windows were summed to produce the effect of triangular transmission windows, in accordance with various embodiments.

FIG. 6 is an exemplary plot 600 of the product ion intensities as a function of precursor mass of a calibration peptide of 829.5393 Da and its two isotopes produced by a low energy collision experiment, where rectangular precursor transmission windows were summed to produce the effect of triangular transmission windows, in accordance with various embodiments. Traces 610, 620, and 630 are for the 829 peptide and its two isotopes, respectively. The 829 peptide and its two isotopes have time-of-flight (TOF) masses 829.545, 830.546, and 831.548, respectively. When traces 610, 620, and 630 are centroided and calibrated, they indicate precursor mass values of 829.58, 830.55, and 831.17, respectively.

In the second experiment, a higher collision energy of 40 eV was used. In this experiment, a calibration peptide of 829.5303 Da and its product ion and isotopes were compared.

Figure 7:
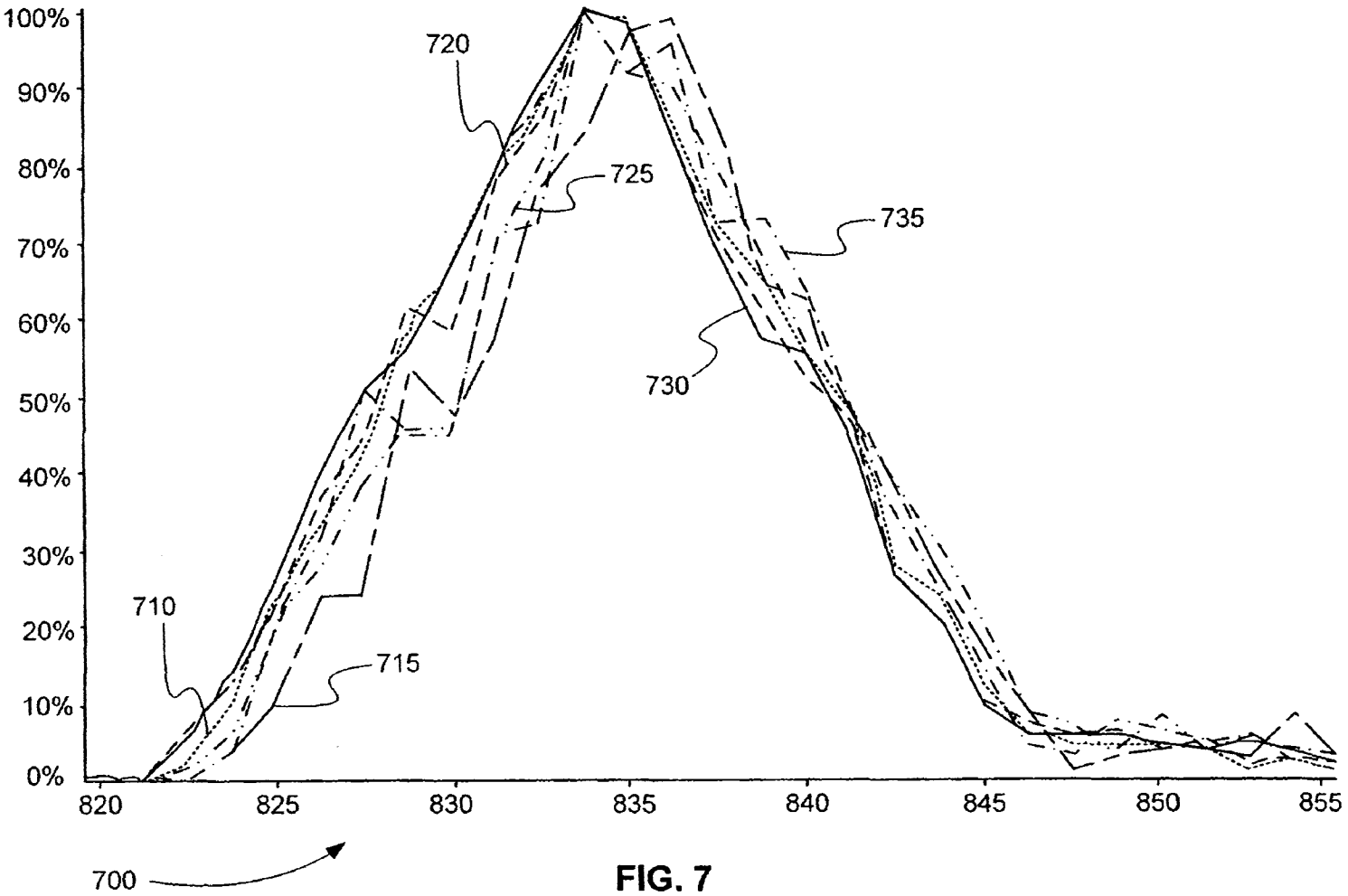
FIG. 7 is an exemplary plot of the product ion intensities as a function of precursor mass of the three most intense product ions and three first isotopes of those product ions produced by a high energy collision experiment performed on a calibration peptide of 829.5303 Da, where rectangular precursor transmission windows were summed to produce the effect of triangular transmission windows, in accordance with various embodiments.

FIG. 7 is an exemplary plot 700 of the product ion intensities as a function of precursor mass of the three most intense product ions and three first isotopes of those product ions produced by a high energy collision experiment performed on a calibration peptide of 829.5303 Da, where rectangular precursor transmission windows were summed to produce the effect of triangular transmission windows, in accordance with various embodiments. Traces 710, 720, and 730 are for product ions that have TOF masses 494.334, 607.417, and 724.497, respectively. Traces 715, 725, and 735 are for product ion first isotopes that have TOF masses 495.338, 608.423, and 725.501, respectively. When traces 710, 720, and 730 are centroided and calibrated, they indicate precursor mass values of 829.48, 829.39, and 829.27, respectively. When traces 715, 725, and 735 are centroided and calibrated, they indicate precursor isotope mass values of 830.53, 830.30, and 830.15, respectively.

FIGS. 6 and 7 verify that by using a triangular shaped effective transmission window to transmit precursor ion within the SWATH precursor mass window, isotopes and product ions can be correlated to their precursor ions within a tolerance level.

Systems for Identifying a Precursor Ion from a Product Ion

Figure 8:
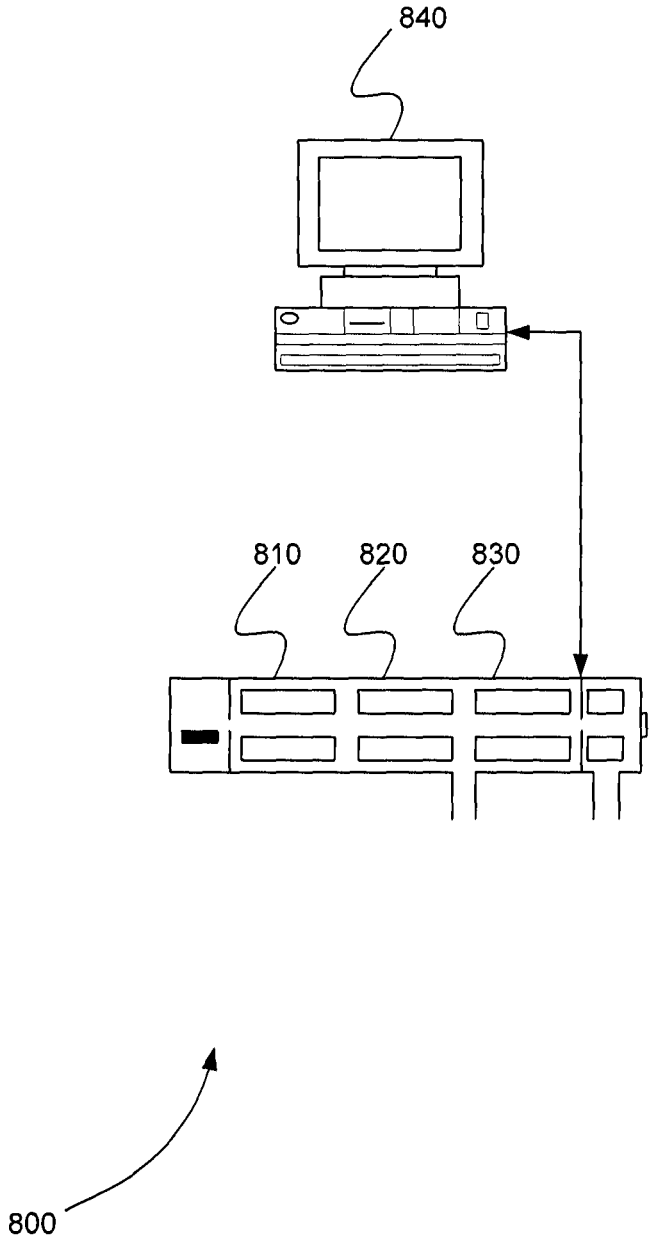
FIG. 8 is a schematic diagram showing a system for identifying a precursor ion of a product ion in a tandem mass spectrometry experiment, in accordance with various embodiments.

FIG. 8 is a schematic diagram showing a system 800 for identifying a precursor ion of a product ion in a tandem mass spectrometry experiment, in accordance with various embodiments. System 800 includes mass filter 810, fragmentation device 820, mass analyzer 830, and processor 840. In system 800, the mass filter, the fragmentation device, and the mass analyzer are shown as different stages of a quadrupole, for example. One of ordinary skill in the art can appreciate that the mass filter, the fragmentation device, and the mass analyzer can include, but are not limited to, one or more of an ion trap, orbitrap, an ion mobility device, or a time-of-flight (TOF) device.

Processor 840 can be, but is not limited to, a computer, microprocessor, or any device capable of sending and receiving control signals and data from a tandem mass spectrometer and processing data. Processor 840 is in communication with mass filter 810 and mass analyzer 830.

Mass filter 810 steps a transmission window across a mass range. The transmission window has a constant rate of precursor ion transmission for each precursor ion. Stepping the transmission window produces a series of overlapping transmission windows across the mass range.

Fragmentation device 820 fragments the precursor ions produced at each step. Mass analyzer analyzes resulting product ions, producing a product ion spectrum for each step of the transmission window and a plurality of product ion spectra for the mass range.

Processor 840 receives the plurality of product ion spectra produced by the series of overlapping transmission windows. For at least one product ion of the plurality of product ion spectra, processor 840 calculates a function that describes how an intensity of the at least one product ion from the plurality of product ion spectra varies with precursor ion mass as the transmission window is stepped across the mass range. Processor 840 identifies a precursor ion of the at least one product ion from the function.

In various embodiments, processor 840 combines groups of product ion spectra from the plurality of product ion spectra produced by the series of overlapping transmission windows to produce a function that describes how an intensity of the at least one product ion per precursor ion from the plurality of combined product ion spectra varies with precursor ion mass and that has a shape that is non-constant with precursor mass. The shape comprises a triangle, for example.

In various embodiments, processor 840 identifies a precursor ion of the at least one product ion from the function by calculating a parameter of a shape of the function. The parameter comprises a center of gravity of the shape, for example.

In various embodiments, mass filter 810 comprises a quadrupole.

In various embodiments, mass analyzer 830 comprises a quadrupole.

In various embodiments, mass analyzer 830 comprises a time-of-flight (TOF) analyzer.

Method for Identifying a Precursor Ion from a Product Ion

Figure 9:
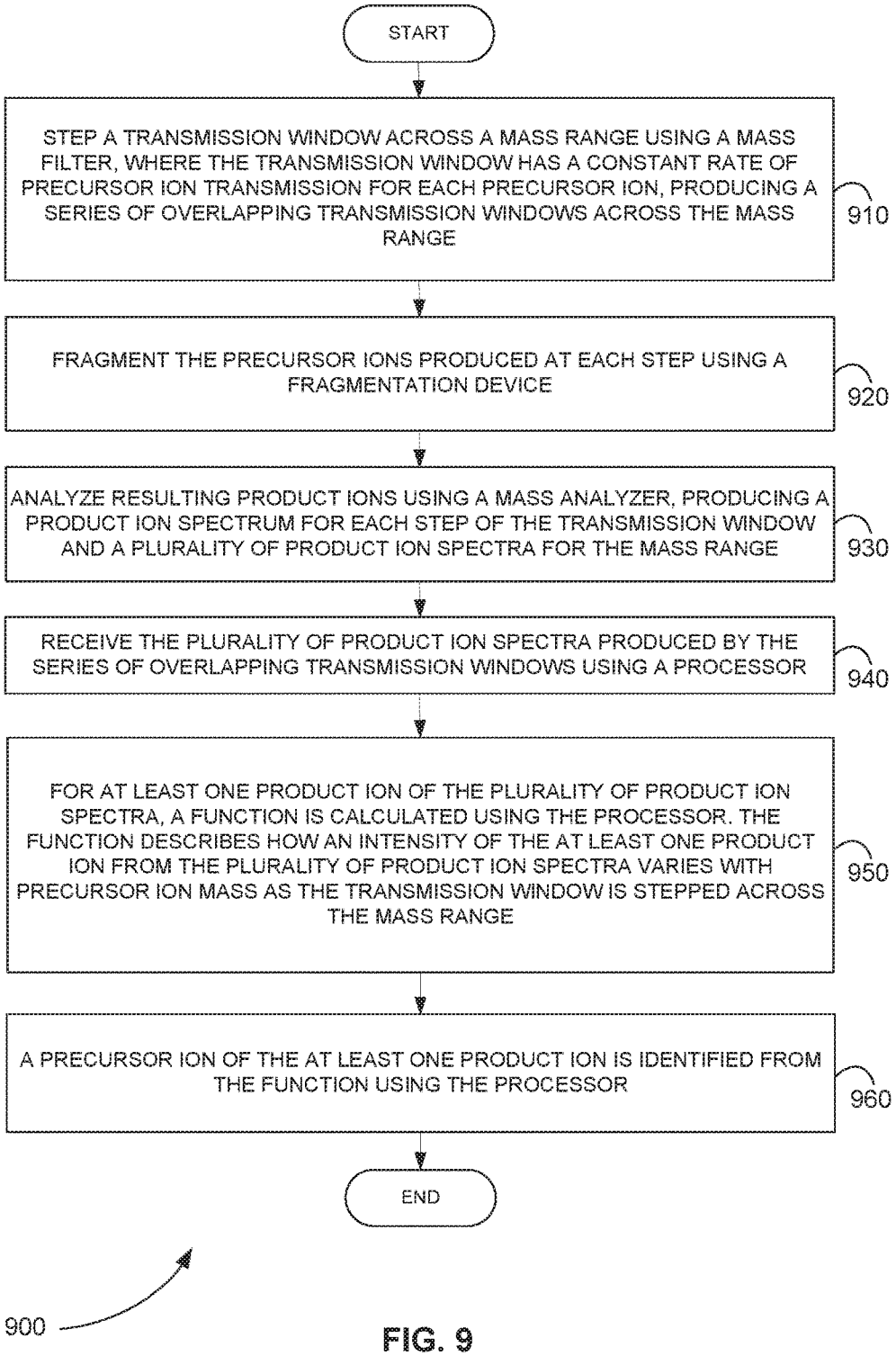
FIG. 9 is an exemplary flowchart showing a method for identifying a precursor ion of a product ion in a tandem mass spectrometry experiment, in accordance with various embodiments.

FIG. 9 is an exemplary flowchart showing a method 900 for identifying a precursor ion of a product ion in a tandem mass spectrometry experiment, in accordance with various embodiments.

In step 910 of method 900, a transmission window is stepped across a mass range using a mass filter. The transmission window has a constant rate of precursor ion transmission for each precursor ion. Stepping the transmission window produces a series of overlapping transmission windows across the mass range.

In step 920, the precursor ions produced at each step are fragmented using a fragmentation device.

In step 930, resulting product ions are analyzed using a mass analyzer. Analyzing the resulting product ions produces a product ion spectrum for each step of the transmission window and a plurality of product ion spectra for the mass range.

In step 940, the plurality of product ion spectra produced by the series of overlapping transmission windows are received using a processor.

In step 950, for at least one product ion of the plurality of product ion spectra, a function is calculated using the processor. The function describes how an intensity of the at least one product ion from the plurality of product ion spectra varies with precursor ion mass as the transmission window is stepped across the mass range.

In step 960, a precursor ion of the at least one product ion is identified from the function using the processor.

Computer Program Product for Identifying a Precursor Ion from a Product Ion

In various embodiments, computer program products include a tangible computer-readable storage medium whose contents include a program with instructions being executed on a processor so as to perform a method for identifying a precursor ion of a product ion in a tandem mass spectrometry experiment. This method is performed by a system that includes one or more distinct software modules.

Figure 10:
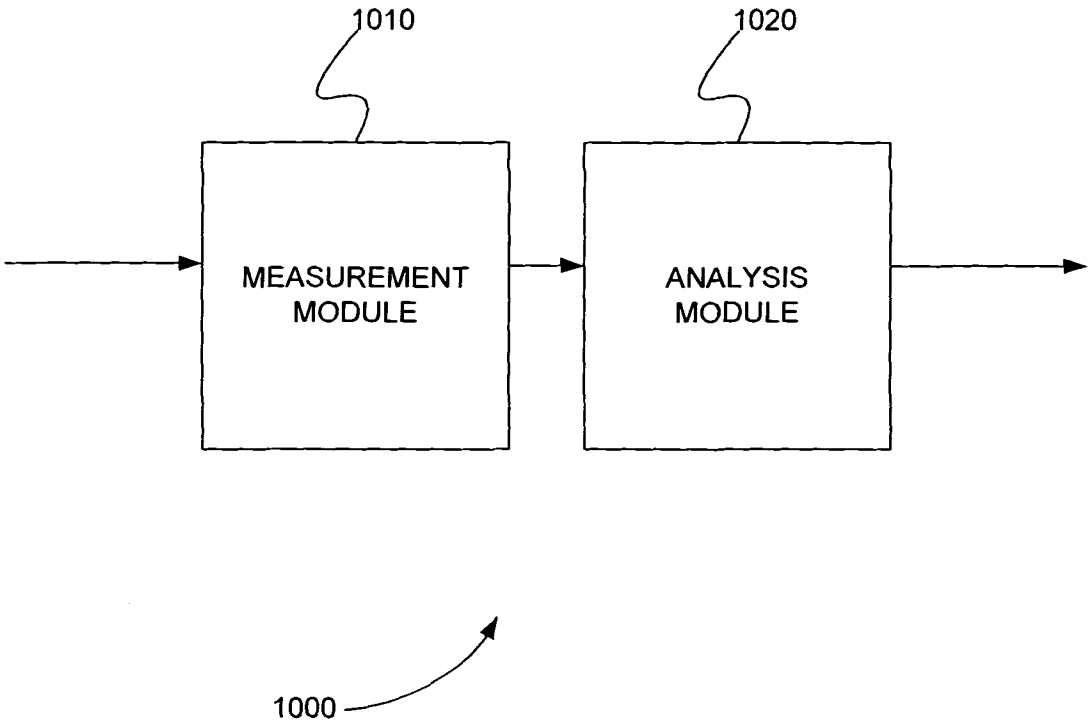
FIG. 10 is a schematic diagram of a system that includes one or more distinct software modules that performs a method for identifying a precursor ion of a product ion in a tandem mass spectrometry experiment, in accordance with various embodiments.

FIG. 10 is a schematic diagram of a system 1000 that includes one or more distinct software modules that performs a method for identifying a precursor ion of a product ion in a tandem mass spectrometry experiment, in accordance with various embodiments. System 1000 includes measurement module 1010 and analysis module 1020.

Measurement module 1010 receives a plurality of product ion spectra produced by a series of overlapping transmission windows. The plurality of product ion spectra are produced by stepping a transmission window that has a constant rate of precursor ion transmission for each precursor ion across a mass range using a mass filter. Stepping the transmission window produces the series of overlapping transmission windows across the mass range. The plurality of product ion spectra are further produced by further fragmenting the precursor ions produced at each step using a fragmentation device. The plurality of product ion spectra are further produced by analyzing resulting product ions using a mass analyzer. Analyzing the resulting product ions produces a product ion spectrum for each step of the transmission window and the plurality of product ion spectra for the mass range.

For at least one product ion of the plurality of product ion spectra, analysis module 1020 calculates a function that describes how an intensity of the at least one product ion from the plurality of product ion spectra varies with precursor ion mass as the transmission window is stepped across the mass range. Analysis module 1020 identifies a precursor ion of the at least one product ion from the function.

System for Reconstructing a Separation Profile

Returning to FIG. 8, a system 800 can also be used for reconstructing a separation profile of a precursor ion in a tandem mass spectrometry experiment from multiple scans across a mass range, in accordance with various embodiments. System 800 can further include a separation device (not shown). The separation device can perform separation techniques that include, but are not limited to, liquid chromatography, gas chromatography, capillary electrophoresis, or ion mobility. The separation device separates ions from a sample over time.

Mass filter 810 receives the ions from the separation device and filters the ions. Mass filter 810 filters the ions by, in each of two or more scans across a mass range, stepping a transmission window that has a constant rate of precursor ion transmission for each precursor ion across the mass range. A series of overlapping transmission windows are produced across the mass range for each scan of the two or more scans. Fragmentation device 820 fragments the precursor ions produced at each step. Mass analyzer 830 analyzes the resulting product ions. A product ion spectrum is produced for each step of the transmission window and a plurality of product ion spectra for the mass range for each scan.

Processor 840 receives the plurality of product ion spectra produced by the series of overlapping transmission windows for each scan, producing a plurality of multi-scan product ion spectra. Processor 840 selects at least one product ion from the plurality of multi-scan product ion spectra that is present at least two or more times in product ion spectra from each of two or more scans. Processor 840 fits a known separation profile of a precursor ion to intensities from the at least one product ion in the plurality of multi-scan product ion spectra to reconstruct a separation profile of a precursor ion of the at least one product ion. A known separation profile is, for example, retrieved from a database (not shown) that stored a plurality of known separation profiles or known functions, such as a Gaussian peak. A separation profile can include, but is not limited to, an LC elution profile.

In various embodiments, overlapping precursor transmission windows from two or more scans across a mass range are also used to provide a stronger signal for identifying the precursor ion. Processor 840 combines product ion spectra at each step across the two or more scans, producing a plurality of combined product ion spectra. For the at least one product ion, processor 840 calculates a function that describes how an intensity of the at least one product ion varies with precursor ion mass as the transmission window is stepped across the mass range. Processor 840 identifies a precursor ion of the at least one product ion from the function.

In various embodiments, Processor 840 combines the product ion spectra at each step across the two or more scans by summing the product ion spectra at each step across the two or more scans.

Method for Reconstructing a Separation Profile

Figure 11:
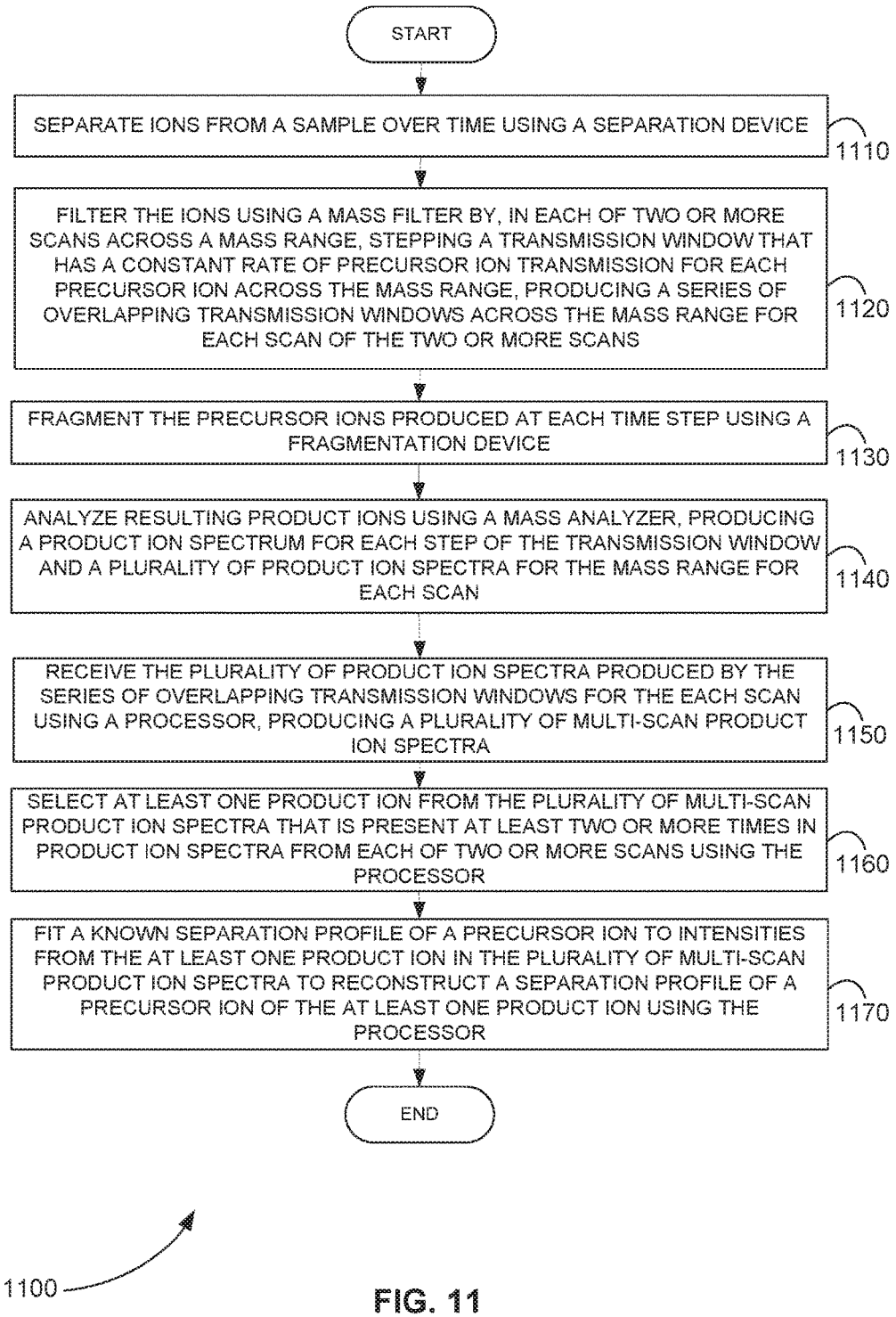
FIG. 11 is an exemplary flowchart showing a method for reconstructing a separation profile of a precursor ion in a tandem mass spectrometry experiment from multiple scans across a mass range, in accordance with various embodiments.

FIG. 11 is an exemplary flowchart showing a method 1100 for reconstructing a separation profile of a precursor ion in a tandem mass spectrometry experiment from multiple scans across a mass range, in accordance with various embodiments.

In step 1110 of method 1100, ions are separated from a sample over time using a separation device.

In step 1120, the ions are filtered using a mass filter by, in each of two or more scans across a mass range, stepping a transmission window that has a constant rate of precursor ion transmission for each precursor ion across the mass range. A series of overlapping transmission windows is produced across the mass range for each scan of the two or more scans.

In step 1130, the precursor ions produced at each step are fragmented using a fragmentation device.

In step 1140, the resulting product ions are analyzed using a mass analyzer. A product ion spectrum is produced for each step of the transmission window and a plurality of product ion spectra is produced for the mass range for each scan.

In step 1150, the plurality of product ion spectra produced by the series of overlapping transmission windows for the each scan, producing a plurality of multi-scan product ion spectra.

In step 1160, at least one product ion is selected from the plurality of multi-scan product ion spectra that is present at least two or more times in product ion spectra from each of two or more scans using the processor.

In step 1170, a known separation profile of a precursor ion is fit to intensities from the at least one product ion in the plurality of multi-scan product ion spectra to reconstruct a separation profile of a precursor ion of the at least one product ion using the processor.

Computer Program Product for Reconstructing a Separation Profile

In various embodiments, computer program products include a tangible computer-readable storage medium whose contents include a program with instructions being executed on a processor so as to perform a method for reconstructing a separation profile of a precursor ion in a tandem mass spectrometry experiment from multiple scans across a mass range. This method is performed by a system that includes one or more distinct software modules.

Returning to FIG. 10, a system 1000 can also be used for reconstructing a separation profile of a precursor ion in a tandem mass spectrometry experiment from multiple scans across a mass range, in accordance with various embodiments.

Measurement module 1010 receives a plurality of product ion spectra for each scan of two or more scans across a mass range produced by a series of overlapping transmission windows, producing a plurality of multi-scan product ion spectra. The plurality of product ion spectra for each scan are produced by separating ions from a sample over time using a separation device and filtering the ions using a mass filter. The ions are filtered by, in each of the two or more scans across the mass range, stepping a transmission window that has a constant rate of precursor ion transmission for each precursor ion across a mass range using a mass filter. Stepping the transmission window produces the series of overlapping transmission windows across the mass range for each scan. The plurality of product ion spectra are further produced by further fragmenting the precursor ions produced at each step using a fragmentation device. The plurality of product ion spectra are further produced by analyzing resulting product ions using a mass analyzer. Analyzing the resulting product ions produces a product ion spectrum for each step of the transmission window and the plurality of product ion spectra for the mass range for each scan.

Analysis module 1020 selects at least one product ion from the plurality of multi-scan product ion spectra that is present at least two or more times in product ion spectra from each of two or more scans. Analysis module 1020 fits a known separation profile of a precursor ion to intensities from the at least one product ion in the plurality of multi-scan product ion spectra to reconstruct a separation profile of a precursor ion of the at least one product ion.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A system for identifying a precursor ion of a product ion in a tandem mass spectrometry experiment, comprising:

a mass filter that moves a transmission window in overlapping steps across a mass range, producing a series of overlapping transmission windows across the mass range, wherein the transmission window transmits precursor ions within the transmission window and wherein the transmission window is moved so that edges of the transmission window define a unique boundary of both precursor ion transmission and product ion intensity as the transmission window is moved across the mass range;

a fragmentation device that fragments the precursor ions transmitted at each overlapping step by the mass filter;

a mass analyzer that analyzes resulting product ions produced by the fragmentation device, producing a product ion spectrum for each overlapping step of the transmission window and a plurality of product ion spectra for the mass range; and a processor in communication with the mass filter and the mass analyzer that receives the plurality of product ion spectra produced by the series of overlapping transmission windows, for at least one product ion of the plurality of product ion spectra calculates a function that describes how an intensity of the at least one product ion from the plurality of product ion spectra varies with the location of the transmission window in terms of precursor ion mass as the transmission window is moved across the mass range in overlapping steps, and identifies a precursor ion of the at least one product ion from the function by calculating a parameter of a shape of the function.

2. The system of claim 1, wherein the processor further combines groups of product ion spectra from the plurality of product ion spectra produced by the series of overlapping transmission windows to produce a function that describes how an intensity of the at least one product ion per precursor ion from the plurality of combined product ion spectra varies with precursor ion mass and that has a shape that is non-constant with precursor mass.

3. The system of claim 2, wherein the shape comprises a triangle.

4. The system of claim 1, wherein the parameter comprises a center of gravity of the shape.

5. The system of claim 1, wherein the mass filter comprises a quadrupole.

6. The system of claim 1, wherein the mass analyzer comprises a quadrupole.

7. The system of claim 1, wherein the mass analyzer comprises a time-of-flight (TOF) analyzer.

8. The system of claim 1, wherein the mass filter, the fragmentation device, and the mass analyzer further perform one or more additional scans of the mass range producing one or more additional pluralities of product ion spectra for the mass range and the processor further receives the one or more additional pluralities of product ion spectra, combines the plurality of product ion spectra and the one or more additional pluralities of product ion spectra by combining product ion spectrum for each step of the transmission window for each scan producing a combined plurality of product ion spectra, for at least one product ion of the combined plurality of product ion spectra, calculates a function that describes how an intensity of the at least one product ion from the combined plurality of product ion spectra varies with precursor ion mass as the transmission window is stepped across the mass range, and identifies a precursor ion of the at least one product ion from the function.

9. A method for identifying a precursor ion of a product ion in a tandem mass spectrometry experiment, comprising:

moving a transmission window in overlapping steps across a mass range using a mass filter, producing a series of overlapping transmission windows across the mass range, wherein the transmission window transmits precursor ions within the transmission window and wherein the transmission window is moved so that edges of the transmission window define a unique boundary of both precursor ion transmission and product ion intensity as the transmission window is moved across the mass range;

fragmenting the precursor ions transmitted at each overlapping step by the mass filter using a fragmentation device;

analyzing resulting product ions produced by the fragmentation device using a mass analyzer, producing a product ion spectrum for each overlapping step of the transmission window and a plurality of product ion spectra for the mass range;

receiving the plurality of product ion spectra produced by the series of overlapping transmission windows using a processor;

for at least one product ion of the plurality of product ion spectra calculating a function that describes how an intensity of the at least one product ion from the plurality of product ion spectra varies with the location of the transmission window in terms of precursor ion mass as the transmission window is moved in overlapping steps across the mass range using the processor; and identifying a precursor ion of the at least one product ion from the function using the processor by calculating a parameter of a shape of the function.

10. The method of claim 9, further comprising combining groups of product ion spectra from the plurality of product ion spectra produced by the series of overlapping transmission windows to produce a function that describes how an intensity of the at least one product ion per precursor ion from the plurality of combined product ion spectra varies with precursor ion mass and that has a shape that is non-constant with precursor mass using the processor.

11. The method of claim 9, further comprising:

performing one or more additional scans of the mass range using the mass filter, the fragmentation device, and the mass analyzer, producing one or more additional pluralities of product ion spectra for the mass range, receiving the one or more additional pluralities of product ion spectra using the processor, combining the plurality of product ion spectra and the one or more additional pluralities of product ion spectra by combining product ion spectrum for each step of the transmission window for each scan using the processor, producing a combined plurality of product ion spectra, for at least one product ion of the combined plurality of product ion spectra, calculating a function that describes how an intensity of the at least one product ion from the combined plurality of product ion spectra varies with precursor ion mass as the transmission window is stepped across the mass range using the processor, and identifying a precursor ion of the at least one product ion from the function using the processor.

12. A computer program product, comprising a non-transitory and tangible computer-readable storage medium whose contents include a program with instructions being executed on a processor so as to perform a method for identifying a precursor ion of a product ion in a tandem mass spectrometry experiment, comprising:

providing a system, wherein the system comprises one or more distinct software modules, and wherein the distinct software modules comprise a measurement module and an analysis module;

receiving a plurality of product ion spectra produced by a series of overlapping transmission windows using the measurement module, wherein the plurality of product ion spectra are produced by moving a transmission window in overlapping steps across a mass range using a mass filter, producing the series of overlapping transmission windows across the mass range, wherein the transmission window transmits precursor ions within the transmission window and wherein the transmission window is moved so that edges of the transmission window define a unique boundary of both precursor ion transmission and product ion intensity as the transmission window is moved across the mass range, fragmenting the precursor ions transmitted at each overlapping step by the mass filter using a fragmentation device, and analyzing resulting product ions produced by the fragmentation device using a mass analyzer, producing a product ion spectrum for each overlapping step of the transmission window and the plurality of product ion spectra for the mass range;

for at least one product ion of the plurality of product ion spectra calculating a function that describes how an intensity of the at least one product ion from the plurality of product ion spectra varies with the location of the transmission window in terms of precursor ion mass as the transmission window is moved in overlapping steps across the mass range using the analysis module; and identifying a precursor ion of the at least one product ion from the function using the analysis module by calculating a parameter of a shape of the function.

13. The method of claim 10, wherein the shape comprises a triangle.

14. The method of claim 9, wherein the parameter comprises a center of gravity of the shape.

15. The method of claim 9, wherein the mass filter comprises a quadrupole.

16. The method of claim 9, wherein the mass analyzer comprises a quadrupole.

17. The method of claim 9, wherein the mass analyzer comprises a time-of-flight (TOF) analyzer.

* * * * *